US009409684B2

(12) United States Patent
Seingier

(10) Patent No.: US 9,409,684 B2
(45) Date of Patent: Aug. 9, 2016

(54) DISPENSER MEMBER FOR DISPENSING A CARE PRODUCT, MAKEUP, OR A TOILETRY

(75) Inventor: Julien Seingier, Colombes (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 30 days.

(21) Appl. No.: 14/126,472

(22) PCT Filed: Jun. 13, 2012

(86) PCT No.: PCT/FR2012/051326

§ 371 (c)(1),
(2), (4) Date: Apr. 17, 2014

(87) PCT Pub. No.: WO2012/172254

PCT Pub. Date: Dec. 20, 2012

(65) Prior Publication Data

US 2014/0224845 A1 Aug. 14, 2014

(30) Foreign Application Priority Data

Jun. 15, 2011 (FR) ..... 11 55199

(51) Int. Cl.
*B65D 88/54* (2006.01)
*B65D 47/24* (2006.01)
(Continued)

(52) U.S. Cl.
CPC ..... *B65D 47/24* (2013.01); *B05B 11/3018* (2013.01); *B05B 11/3053* (2013.01); *B05B 1/32* (2013.01); *B05B 1/326* (2013.01); *B05B 11/00* (2013.01); *B05B 11/3019* (2013.01);
(Continued)

(58) Field of Classification Search
CPC .... B05C 5/0225; B05C 5/0229; B65D 88/54; B65D 47/243; B65D 47/283; B05B 1/32; B05B 1/326; B05B 11/00; B05B 11/3001; B05B 11/3074
USPC ..... 222/380, 504, 522–525, 321.3, 222/321.7–321.9; 239/333
See application file for complete search history.

(56) References Cited

U.S. PATENT DOCUMENTS 4,261,485 A * 4/1981 Borg ..... 222/500
5,004,127 A 4/1991 Morel
(Continued)

FOREIGN PATENT DOCUMENTS

CN 1038062 A 12/1989
CN 1915758 A 2/2007
(Continued)

OTHER PUBLICATIONS

International Search Report issued in International Patent Application No. PCT/FR2012/051326 dated Oct. 11, 2012.
(Continued)

*Primary Examiner* — Paul R Durand
*Assistant Examiner* — Andrew P Bainbridge
(74) *Attorney, Agent, or Firm* — Harness, Dickey & Pierce, P.L.C.

(57) ABSTRACT

The dispenser member for dispensing fluid, the dispenser member includes a pump, a push-button configured to control dispensing of the fluid, a dispensing nozzle in the push-button, a shutter of the nozzle, and at least one magnet configured to move the shutter relative to the nozzle upon activation of the push-button. The fluid may include at least one of a care product, make-up, and toiletry.

11 Claims, 2 Drawing Sheets

(51) Int. Cl.

| | |
|---|---|
| *B05C 5/02* | (2006.01) |
| *B05B 11/00* | (2006.01) |
| *B05B 1/32* | (2006.01) |

(52) U.S. Cl.

CPC ..... *B05B11/3047* (2013.01); *B05C 5/0225* (2013.01); *B05C 5/0229* (2013.01); *B65D 88/54* (2013.01)

(56) References Cited

U.S. PATENT DOCUMENTS

| | | | | |
|---|---|---|---|---|
| 5,014,883 | A * | 5/1991 | Airaksinen | B44D 3/003 137/862 |
| 5,875,938 | A * | 3/1999 | Graf | B05B 11/3001 222/321.7 |
| 6,250,515 | B1 * | 6/2001 | Newbold et al. | 222/504 |
| 7,048,155 | B2 * | 5/2006 | Kuwahara et al. | 222/321.9 |
| 7,172,098 | B2 * | 2/2007 | Garcia et al. | 222/402.13 |
| 7,367,476 | B2 | 5/2008 | Law et al. | |
| 7,467,629 | B2 * | 12/2008 | Rand | A61M 15/009 128/200.14 |
| 2010/0072301 | A1 | 3/2010 | Cater | |

FOREIGN PATENT DOCUMENTS

| | | | |
|---|---|---|---|
| EP | 0 335 457 | A2 | 10/1989 |
| EP | 0 794 010 | A1 | 9/1997 |
| EP | 2 165 770 | A1 | 3/2010 |
| FR | 2 838 070 | A1 | 10/2003 |
| JP | 2005238180 | A | 9/2005 |
| JP | 2009082793 | A | 4/2009 |
| JP | 2010071283 | A | 4/2010 |
| JP | 2010516447 | A | 5/2010 |
| WO | WO 00/55072 | A2 | 9/2000 |
| WO | WO-2008091635 | A2 | 7/2008 |

OTHER PUBLICATIONS

Written Opinion issued in International Patent Application No. PCT/FR2012/051326 dated Oct. 11, 2012.

Office Action for corresponding Japanese Application No. 2014-515260 dated Dec. 22, 2015 and English translation thereof.

Office Action for corresponding Chinese Application No. 2012-80039855.4 dated Aug. 24, 2015 and English translation thereof.

* cited by examiner

DISPENSER MEMBER FOR DISPENSING A CARE PRODUCT, MAKEUP, OR A TOILETRY

The invention relates to dispenser members for dispensing fluids, e.g. care products, toiletries, or makeup.

BACKGROUND OF THE INVENTION

Document FR 2 838 070, in particular, discloses a fluid container that is provided with a dispenser member that includes a push-button that, when actuated, causes a slider to retract so as to open an orifice of a fluid dispenser nozzle.

The composition of toiletries, care products, or makeup is becoming more and more complex, such that their properties and their behavior constantly require novel dispenser members to be designed.

Such dispenser members perform numerous functions. They should be sufficiently leaktight in their closed positions. They should be easy to use. The fluid should not cause the shutter to stick to the nozzle. The fluid should not dry on the outside of the nozzle, possibly causing it to be squirted or deflected while being dispensed, or possibly causing lumps or flakes to be included in the dispensed fluid. It is desirable for the volume that is occupied by the fluid between the nozzle and the pump that serves to bring it as far as the dispenser member, i.e. the "dead" volume, to be as small as possible. This makes the mechanism easier to operate, and avoids fluid stagnating for a long period in this volume. Furthermore, it is desirable that the dispenser member is inexpensive.

OBJECTS AND SUMMARY OF THE INVENTION

It is in such a context that an object of the invention is to provide a novel fluid dispenser member.

To this end, the invention provides a fluid dispenser member that includes:

- a nozzle;
- a shutter of the nozzle; and
- at least one magnet that is suitable for moving the shutter relative to the nozzle.

Thus, the presence of the magnet(s) make(s) it possible to simplify the mechanism considerably, in particular by reducing the number of parts that it is made up of, thereby also making it easier to assemble. Moving the shutter by magnetic interaction does not require direct contact between any of the parts. Furthermore, by means of the invention, the mechanism may be configured so as to have a dead volume that is very small and a cost price that is moderate.

Advantageously, the magnet or one of the magnets is suitable for moving the shutter in the opposite direction to the nozzle.

Advantageously, the magnet or one of the magnets is suitable for moving the shutter in the direction of the nozzle.

Preferably, the member includes:

- a first magnet that is suitable for moving the shutter in the opposite direction to the nozzle; and
- a second magnet that is suitable for moving the shutter in the direction of the nozzle.

Thus, magnetic interaction is implemented both for opening the nozzle and for closing it. It is thus possible to eliminate providing a return spring for moving the shutter in one of the two directions. And the mechanism may have a particularly small number of parts.

In an embodiment, the magnet or at least one of the magnets is mounted to move relative to the shutter.

Provision may be made for the magnet or at least one of the magnets to be fastened rigidly to the shutter.

Thus, it is not necessary to provide a ferromagnetic material in the shutter for it to interact with the magnet.

Provision may also be made for the member to include:

- a magnet-carrier that is mounted to move relative to the nozzle and to the shutter;
- a pump; and
- a return spring for returning the magnet-carrier, the spring being outside the pump.

Preferably, the shutter includes a piston that is arranged such that fluid pressure at a feed orifice of the member tends to move the shutter in the opposite direction to the nozzle.

Thus, the flow pressure from the pump is exerted on the shutter so as to urge said shutter in the opening direction. It is thus possible to reduce the size of the means for moving the shutter in order to open it. This arrangement also makes it possible to accelerate the movement of the shutter.

Advantageously, the nozzle and the shutter present mutual contact faces that slope relative to a direction of movement of the shutter relative to the nozzle.

Such faces make it possible to constitute a small contact zone between the shutter and the nozzle, thereby reducing the risks of the shutter sticking to the nozzle by means of any fluid that might be interposed between them.

Advantageously, the member presents a fluid outlet duct, the duct including portions in relief for guiding the shutter.

The portions in relief reduce the contact area between the shutter and the other parts of the mechanism, and thus correspondingly reduce the friction opposing its movement while the nozzle is being opened and closed. And they reduce the risks of the shutter sticking in the duct. Nevertheless, the portions in relief allow the fluid to pass along the shutter.

The invention also provides a container, such as a bottle, that includes a member of the invention.

An article is also provided that comprises such a container and a fluid that forms part of at least one of the following types:

- a care product;
- makeup; and
- a toiletry.

Other characteristics and advantages of the invention appear further from the following description of an embodiment, given by way of non-limiting example, and with reference to the accompanying drawings, in which:

MORE DETAILED DESCRIPTION

FIGS. 1 to 5 show a dispenser member 2 for dispensing a viscous fluid 10, and its pump 4.

Figure 1:
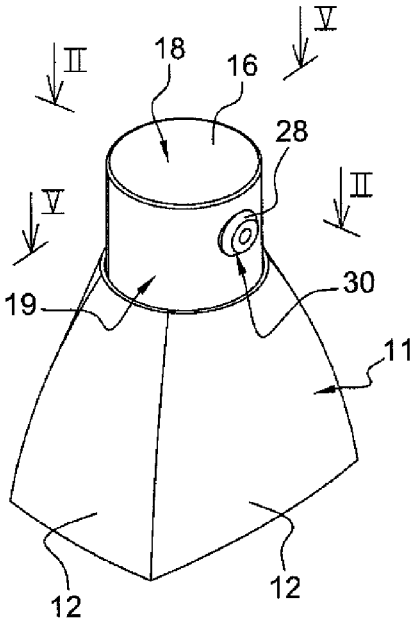
FIG. 1 is a perspective view of a dispenser member of the invention.
Figure 2:
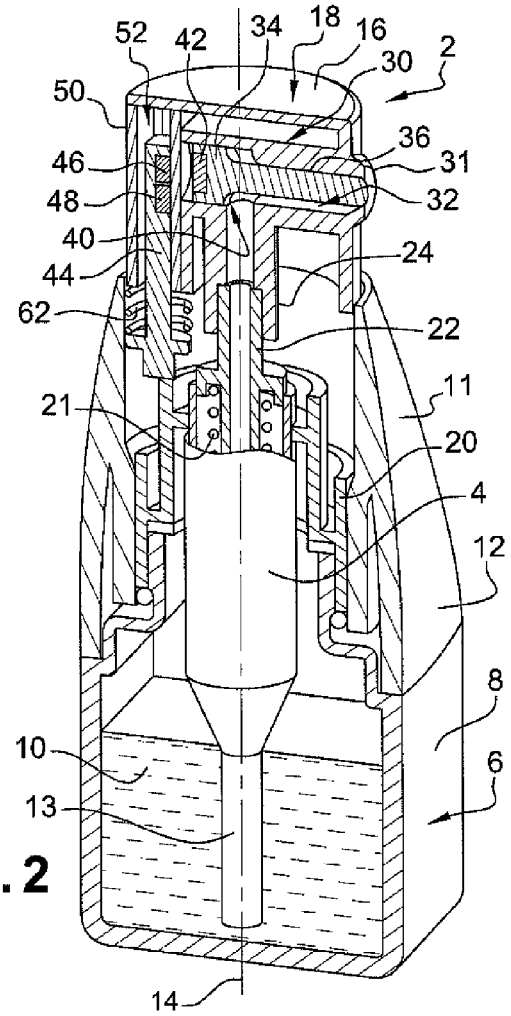
FIG. 2 is a perspective and section view on plane II-II of a container including the FIG. 1 member.

As shown in FIG. 2, the member 2 with its pump is for forming part of a container such as a bottle 6 including a fluid reservoir 8. The pump body 4 includes a bottom inlet duct 13 having a bottom end that extends into the bottom portion of the reservoir so as to dip into the fluid 10. The member 2 is mounted in the top portion of the reservoir that it closes, and it is associated with a decorative hoop 11.

Figure 6:
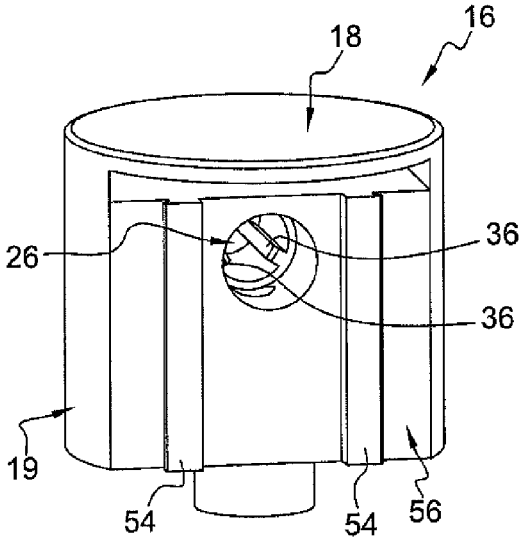
FIGS. 6 to 10 are perspective views of respective parts of the mechanism of the FIG. 1 member.
Figure 7:
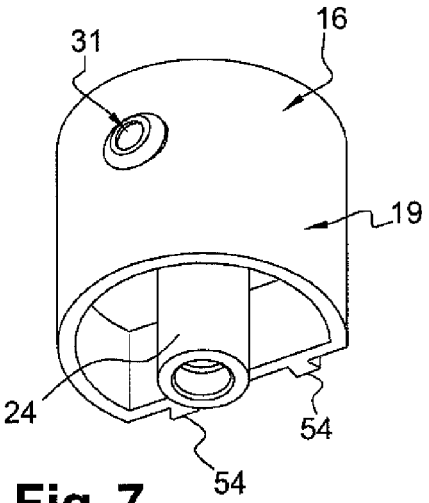

The member 2 includes a push-button 16 that forms the top of the member, that emerges from the hoop 11, and that has a base that penetrates into the top of said hoop. The push-button 16, shown in particular in FIGS. 6 and 7, presents a top face 18, specifically in the shape of a disk, and a cylindrical side face 19 having a circular section in a plane that is perpendicular to the axis 14. The button 16 is movably mounted to slide relative to the reservoir 8 along the axis 14.

The pump, of a type known per se and not described in detail herein, includes the pump body 4 and a pump seat 20 that connects the pump body to the reservoir. The body includes a top outlet or flow duct 22 that emerges from the top of the body and that is parallel to the axis 14, as is the bottom duct 13. The top duct 22 is fastened rigidly to a sleeve 24 of the push-button, and is movably mounted to slide relative to the pump body along the axis 14. As a result, when the user presses on the face 18, the button 16 is caused to descend integrally with the duct 22, relative to the reservoir and to the hoop, thereby pumping fluid 10 from the duct 13 into the body 4, then into the outlet duct 22, and into the button 16 inside the sleeve 24.

In this configuration, the hoop 11 presents four outer faces 12 that succeed one another around a main axis 14 of the member. In section, in a plane that is perpendicular to the axis, the hoop presents a shape that is generally rectangular, the rectangle tapering in size from the base of the hoop to its top. Other forms of hoop may also be suitable.

The button 16 presents a transverse housing 26 that is perpendicular to the axis 14 and that intersects said axis. The internal duct of the sleeve 24 opens out via its top end into the housing 26. The housing presents an external end 31 that opens out into the side face 19, specifically at the portion in relief 28 that projects from said side face. The end 31 forms a dispenser nozzle for dispensing fluid.

Figure 8:
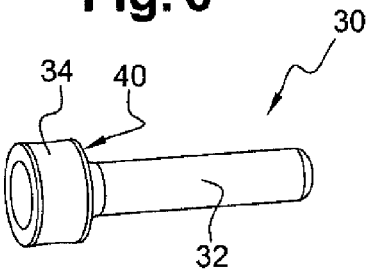
Figure 9:
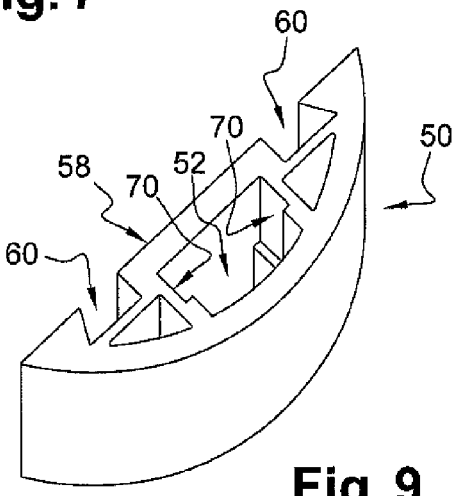

The housing 26 receives an internal shutter 30, or pin, that is movably mounted to slide in the housing along the direction of said housing relative to the push-button. The shutter 30, shown in particular in FIG. 8, presents a shape that is generally circularly symmetrical about its longitudinal axis. It presents a front portion 32, and a rear portion 34 of diameter that is greater than the front portion.

The front portion 32 extends in a front portion of the housing 26 that forms a fluid transfer duct. This portion of the duct presents a generally cylindrical shape having a circular section in a plane that is perpendicular to its axis. It presents portions in relief 36 that are formed specifically by rectilinear elongate splines that project radially from the cylindrical face and along the slide direction. The splines 36 are spaced apart from one another and they are distributed regularly around the axis of the duct. In this configuration, they are three in number, this number being non-limiting. The flat top of each spline is in contact with the front portion 32 of the shutter, such that said shutter is guided to slide in the front portion of the housing 26 bearing against the three splines. Between them and around the front portion 32 of the shutter, the splines form channels for conveying the fluid in the front portion of the housing and as far as the nozzle 31.

Figure 3:
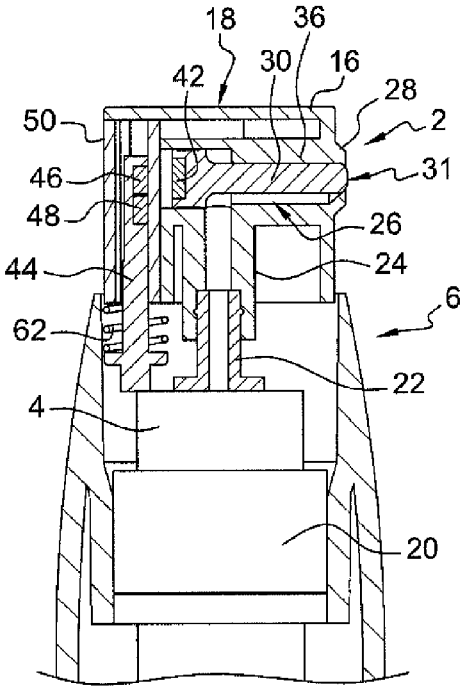
FIGS. 3 and 4 show, on the same section plane, the FIG. 1 member with the nozzle in its closed and open positions respectively, the remainder of the container being shown in simplified manner.
Figure 4:
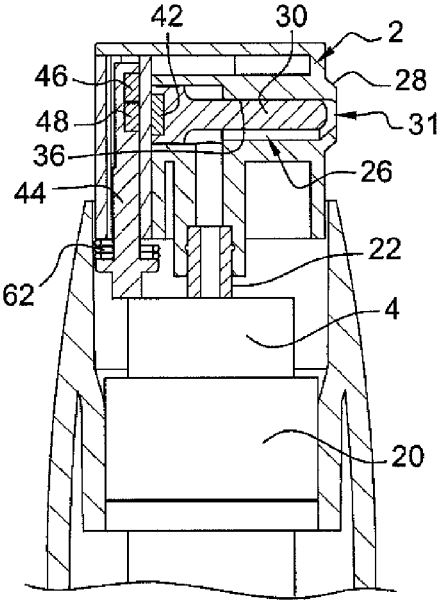
Figure 5:
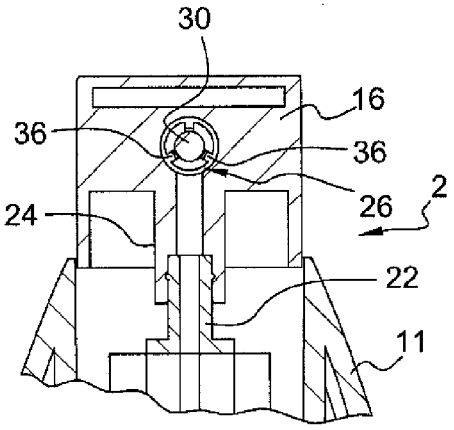
FIG. 5 is a partial section view on plane V-V of the FIG. 1 member.

At the leading end of the housing, the inner face of said housing presents a beveled or frustoconical segment. At its leading end, the shutter 30 presents a face of complementary frustoconical shape for which the above-mentioned end of the housing forms a seat. The two surfaces thus come to bear surface on surface against each other when the shutter 30 closes the nozzle 31, as shown in FIGS. 2 and 3. The bottle is thus closed in leaktight manner with regard to the fluid 10. This position is the advanced or closed position of the shutter. For dispensing fluid, the shutter occupies a retracted position or an open position in which its leading end lies at a distance from the nozzle 31, as shown in FIG. 4, and thus enables the fluid to escape via the nozzle.

The rear portion 34 of the shutter lies beside the axis 14 and is situated remote from the nozzle 31 regardless of the position of the shutter in the housing. In its rear portion, the housing 26 does not have any portions in relief, such that the cylindrical face of the portion 34 is in leaktight surface on surface contact with the cylindrical face of the rear portion of the housing. The shutter 30 presents a shoulder 40 at the junction between its front and rear portions 32, 34 that, because of the position occupied by the shutter, may be subjected to the delivery pressure of the pump. Under the effect of the pressure, the portion 34 thus forms a piston that slides in the cylinder formed by the rear portion of the housing. Given this arrangement, the pump pressure as transmitted by the fluid, when it appears, tends to cause the shutter to retract so as to open the nozzle whenever the user presses on the button 16.

At its rear end, the shutter 30 carries a magnet 42. In this configuration, the magnet is in the shape of a disk and is fastened rigidly on the axis of the body of the shutter so as to present circular symmetry.

Figure 10:
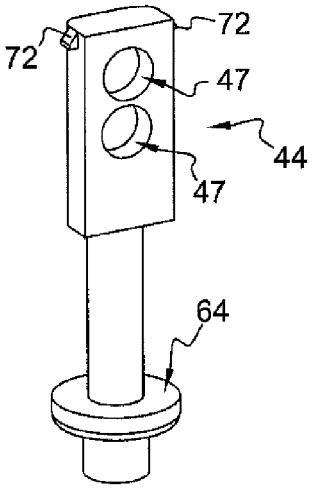

With reference to FIG. 10 in particular, the member 2 includes a magnet-carrier 44 that, in the present embodiment, carries a top magnet 46 and a bottom magnet 48 that is situated below the top magnet. The two magnets are fastened rigidly to the magnet-carrier on the side of said magnet-carrier that is directed towards the shutter 30.

The magnet 42 may be fitted on the shutter 30 and, by way of example, may be adhesively bonded to said shutter or embedded in the plastics material of the shutter. The same applies for the magnets 46 and 48 of the magnet-carrier 44 that are received in the cavities 47 of said magnet-carrier.

In the present embodiment, the member includes a cover 50 that is fastened rigidly to a rear portion of the button 16 that is shaped for this purpose. To this end, in this embodiment the button 16 presents two splines 54 of dovetail section that project from a plane rear face 56 of the button. The cover 50 presents a plane front face 58 that is shaped by two channels 60 that are also of dovetail section and of shape that is complementary to the shape of the splines 54 that they receive. This assembly makes it possible to fasten the cover rigidly to the button by sliding it parallel to the axis 14 until it comes into axial abutment against the top of the button 16. The cover presents a housing 52 that extends along a direction that is parallel to the axis 14, and in which the magnet-carrier is received.

The stroke of the push-button along the axis 14, relative to the pump seat 20, is limited at its two ends by two abutments that are not shown and that, by way of example, are situated in the pump body 4 since they already limit the stroke of the duct 22 to which the button is rigidly fastened.

The member 2 includes a return spring 62 having a helix that has an axis that is parallel to the axis 14. The spring presents a top end that is in axial abutment against the bottom face of the cover 50, and a bottom end that is in axial abutment against a bottom shoulder 64 that is formed on the magnet-carrier. The spring holds the magnet-carrier in abutment against the pump seat 20. In this embodiment, it should be observed that the spring is independent and distinct from a spring 21 that is provided in the pump for operating said pump, and that tends to push the duct 22 upwards relative to the remainder of the pump body 4.

The magnet-carrier 44 is thus stationary relative to the pump seat 20, and the push-button 16 with the cover 50 is slidably movable relative to the magnet-carrier along a direction that is parallel to the axis 14.

The top magnet 46 is arranged and positioned so that it tends, by magnetic interaction, to repel the magnet 42 of the shutter when the two magnets are in alignment, as in the closed position of the nozzle shown in FIGS. 2 and 3. The magnet thus causes the shutter to press against the nozzle seat, and holds said nozzle in its closed position.

Conversely, the bottom magnet 48 is arranged and positioned so that it tends to attract the magnet 42 of the shutter when said bottom magnet is placed in alignment with said shutter, as in FIG. 4. It thus causes the nozzle to open and holds it in its open position.

In this configuration, the hoop 11 presents four outer faces 12 that succeed one another around a main axis 14 of the member. In section, in a plane that is perpendicular to the axis, the hoop presents a shape that is generally rectangular, the rectangle tapering in size from the base of the hoop to its top. Other forms of hoop may also be suitable.

The member functions as follows.

At rest, the member lies in the configuration shown in FIGS. 2 and 3 in which the nozzle 31 is closed by the shutter 30 under the effect of the magnets 42 and 46 that lie on the same axis and that are separated only by a wall of the cover 50. The button 16 occupies its high position. It is held in this position mainly by the spring 21 of the pump and in part by the spring 62.

When the user wishes to obtain some of the fluid 10, the user presses on the disk 18 so as to push the button down against the force of the springs.

During this movement that takes the shutter with it, the magnet 42 moves down relative to the magnets 46 and 48. It thus ceases to lie on the same axis as the top magnet 46 and passes into alignment with the bottom magnet 48 so that it is then subjected to its magnetic attraction, through the wall of the cover 50.

In addition, as explained above, the movement of the button delivers fluid into the sleeve 24 in which the fluid pressure tends to increase. The pressure is exerted on the piston 34 against the magnetic repulsion force whereby the top magnet 46 repels the magnet 42 and thus the shutter.

This attraction, and specifically the pre-loading resulting from the fluid pressure, causes the shutter to retract so as to open the nozzle 31 and cause the fluid to escape from the member. The bottom magnet 48 holds the nozzle open while the user maintains pressure on the button.

Specifically, the length of the stroke of the button is greater than the center-to-center distance between the magnets 46 and 48. Thus, the shutter moves down lower than the magnet 48 in order to cause the nozzle to open before the button is fully depressed, so as to enable the fluid to be properly dispensed.

When the user releases the pressure, the push-button rises under the effect of the springs 21 and 62 returning. The shutter thus returns to the height of the top magnet 46 and is subjected to the repulsion from said top magnet. The shutter thus slides until the nozzle 31 is closed.

In the present embodiment, the magnet-carrier 44 is mounted in the cover 50, with two portions in relief 72 at the top of said magnet-carrier being guided to slide in a top portion of the duct 52 by two side ways 70. In order to mount the magnet-carrier in the cover, its top is inserted via the bottom end of the duct 52, forcing in the portions in relief 72 that rub against a narrow bottom portion of the duct until they reach the recesses 70 in which they can slide without substantial friction. Beyond a predetermined stroke, the bottom shoulder 64 of the magnet-carrier limits its upward movement relative to the cover. The magnet-carrier is thus held captive in the cover. The two parts may be pre-assembled, then transported and stored in this configuration, before being mounted on the member 2.

In this embodiment, the member is assembled as follows.

The shutter 30 fitted with its magnet 42 is inserted into the housing 26 of the push-button via the rear end of the housing.

Once the magnet-carrier is fitted with the magnets 46 and 48, the spring 62 is installed on the magnet-carrier, then said magnet-carrier is installed in the cover 50, as mentioned above.

The cover 50 is then slid onto the splines 54 of the button 16, thereby enclosing the shutter in the housing 26.

In order to assemble the container, the pump and the hoop 11 are mounted on the bottle. The pump and the hoop are snap-fastened on the neck of the bottle, and the hoop thus locks the pump assembly on the neck. Finally, the push-button 16 with its shutter 30 and the magnets is mounted on the top duct 22 of the pump. In a variant, the push-button could be pre-assembled with the pump before said pump is mounted on the bottle.

For the magnets 42, 46, and 48, the magnets sold by Supermagnete under the references S-02-01-N and S-03-01-N could be used, for example. Those magnets are disk shaped, have a height of 2 millimeters (mm), and they have diameters of 2 mm and 3 mm respectively. They present type N48 magnetization for attraction forces of 130 grams (g) to 210 g respectively. Other magnets may be suitable.

In order to achieve suitable sealing at the contact of the piston 34 with the rear of the housing 26, it suffices to provide suitable manufacturing tolerances and surface states. A sealing gasket may also be provided.

It can be seen that this mechanism is particularly simple and comprises a small number of parts. The only parts that are movable relative to one another in operation are the push-button 16, the shutter 30, the magnet-carrier 44, and the spring 62, making a total of four in this embodiment.

By relying on the magnetic interaction exerted by one or more magnets, the member makes it possible to do without levers or ramps, and avoids causing the shutter to be moved merely by fluid or air pressure.

The dead volume occupied by the fluid downstream from the pump and upstream from the nozzle is no more than the volume of the sleeve 24 plus the volume of the front portion of the housing 26 that is not occupied by the shutter. It is thus particularly small. There is no large zone in which fluid stagnates.

This mechanism makes it possible to actuate the pump as soon as the push-button starts to be depressed. In this respect, there is thus no dead stroke. As a result, the action of the user is more effective and produces a better yield. Furthermore, the fluid follows a short path between leaving the pump and being dispensed via the nozzle 31.

In particular, the shape of the nozzle 31 and the arrangement of the mechanism avoids the problems of the fluid drying at the nozzle, of the fluid being deflected or squirted while it is being dispensed, or the presence of lumps in the dispensed fluid.

Apart from the magnets and the spring, all of the components of the dispenser member may be made by injection-molding plastics material.

The fluid 10 may be makeup, toiletries, or care products. It may be a cream or an emulsion. It may be used for the face or the body. It may be viscous to a greater or lesser extent, indeed it may be a paste.

Naturally, numerous modifications could be applied to the invention without going beyond the ambit thereof.

Provision could be made for the magnet-carrier 44 to be fastened rigidly to the pump seat 20 and for the return spring 62 associated with the magnet-carrier to be eliminated.

The progressive loading of the piston 34 by the pressure exerted by the pump could be eliminated.

It is not essential to provide three magnets for implementing the invention.

Provision could thus be made for the magnet-carrier to carry only one magnet 46 that is suitable for repelling the magnet of the shutter, so as to place said shutter in its closed position. By way of example, a return spring could be used that is suitable for bearing against the push-button and against the shutter so as to move said shutter towards its open position when the magnet 42 is no longer subjected to the repulsion of the magnet 46. Conversely, provision could be made for the magnet-carrier to carry only the magnet 48 that is suitable for attracting the magnet of the shutter so as to open the nozzle, associating with said shutter a return spring that moves the shutter so as to close the nozzle when it is no longer subjected to the attraction of the magnet.

In another embodiment, the two magnets 46 and 48 could be made in the form a single magnet that is suitable on its own for attracting and repelling the magnet 42 depending on the position occupied by said magnet 42.

It is also possible to provide a single magnet that is placed either on the shutter, or on the magnet-carrier or some other support, so as to move the shutter when a portion made of ferromagnetic metal is attracted by the magnet against the return force of a spring.

It is possible to give the magnets diameters that are different from the diameters mentioned above, or to give them a shape that is oval, rectangular, or square.

It is possible to arrange the housing 26 as a circularly-cylindrical housing that opens out to the front face of the push-button 16. The shutter is inserted into the housing from the front face of the push-button, and a separate element is then inserted that includes both guide splines 36 for guiding the shutter, and the fluid dispensing nozzle 31. The shutter is thus guided in the same way as described above. This structure makes it possible to fabricate the shutter with a cover that is made integrally with the remainder of the push-button.

The invention claimed is:

1. A dispenser member for dispensing fluid, the dispenser member including:

a pump;

a push-button configured to control dispensing of the fluid;

a dispensing nozzle in the push-button;

a shutter of the nozzle; and at least one magnet configured to move the shutter relative to the nozzle upon activation of the push-button, wherein the fluid includes at least one of a care product, make-up, and toiletry.

2. A member according to the claim 1, wherein the magnet or one of the magnets is suitable for moving the shutter in the opposite direction to the nozzle.

3. A member according to claim 1, wherein the magnet or one of the magnets is suitable for moving the shutter in the direction of the nozzle.

4. A member according to claim 1, which member includes:

a first magnet that is suitable for moving the shutter in the opposite direction to the nozzle; and a second magnet that is suitable for moving the shutter in the direction of the nozzle.

5. A member according to claim 1, wherein the magnet or at least one of the magnets is mounted to move relative to the shutter.

6. A member according to claim 1, wherein the magnet or at least one of the magnets is fastened rigidly to the shutter.

7. A member according to claim 1, further including:

a magnet carrier that is mounted to move relative to the nozzle and to the shutter;

and a return spring for returning the magnet-carrier, the spring being outside the pump.

8. A member according to claim 1, wherein the shutter includes a piston that is arranged such that fluid pressure at a feed orifice of the member tends to move the shutter in the opposite direction to the nozzle.

9. A member according to claim 1, wherein the nozzle and the shutter present mutual contact faces that slope relative to a direction of movement of the shutter relative to the nozzle.

10. A member according to claim 1, which member presents a fluid outlet duct, the duct including portions in relief for guiding the shutter.

11. A container, such as a bottle, including a member according to claim 1.

* * * * *